US007265744B2

(12) United States Patent
Lee et al.

(10) Patent No.: US 7,265,744 B2
(45) Date of Patent: Sep. 4, 2007

(54) LIQUID CRYSTAL DISPLAY DEVICE AND DRIVING METHOD THEREOF

(75) Inventors: Seung Yeub Lee, Kyongsangbuk-do (KR); Jae Hyun Park, Daegu-kwangyokshi (KR)

(73) Assignee: LG.Phillips LCD Co., Ltd., Seoul (KR)

( * ) Notice: Subject to any disclaimer, the term of this patent is extended or adjusted under 35 U.S.C. 154(b) by 293 days.

(21) Appl. No.: 10/394,177

(22) Filed: Mar. 24, 2003

(65) Prior Publication Data

US 2004/0119672 A1 Jun. 24, 2004

(30) Foreign Application Priority Data

Dec. 20, 2002 (KR) ..... 10-2002-0081981

(51) Int. Cl.
*G09G 3/36* (2006.01)

(52) U.S. Cl. ..... 345/103; 345/100

(58) Field of Classification Search ..... 345/87, 345/92, 93, 94, 99, 100, 103, 53, 89, 98, 345/690

See application file for complete search history.

(56) References Cited

U.S. PATENT DOCUMENTS 4,560,982 A * 12/1985 Sonehara et al. ..... 345/89
5,748,165 A * 5/1998 Kubota et al. ..... 345/96
5,784,042 A * 7/1998 Ono et al. ..... 345/94
6,323,521 B1 * 11/2001 Seo ..... 257/347
6,359,606 B1 * 3/2002 Yudasaka ..... 345/87
6,636,206 B1 * 10/2003 Yatabe ..... 345/204
6,690,347 B2 * 2/2004 Jeon et al. ..... 345/100
6,750,835 B2 * 6/2004 Azami ..... 345/89
6,812,908 B2 * 11/2004 Lim ..... 345/87
2003/0043104 A1 * 3/2003 Lee et al. ..... 345/92
2005/0001800 A1 * 1/2005 Ha ..... 345/87

* cited by examiner

*Primary Examiner*—Kevin M Nguyen
(74) *Attorney, Agent, or Firm*—McKenna Long & Aldridge LLP

(57) ABSTRACT

A liquid crystal display device and a driving method thereof are disclosed in the present invention. The liquid crystal display device includes a plurality of first data lines connected to a data integrated circuit, a plurality of second data lines connected to liquid crystal cells and having the number of data lines at least one more than that of the first data lines, and a switching part in each of the first data lines applying a video signal supplied from the first data lines to the second data lines.

39 Claims, 6 Drawing Sheets

LIQUID CRYSTAL DISPLAY DEVICE AND DRIVING METHOD THEREOF

This application claims the benefit of the Korean Patent Application No. P2002-081981 filed on Dec. 20, 2002, which is hereby incorporated by reference.

BACKGROUND OF THE INVENTION

1. Field of the Invention

The present invention relates to a liquid crystal display device, and more particularly, to a liquid crystal display device and a driving method thereof. Although the present invention is suitable for a wide scope of applications, it is particularly suitable for reducing the number of integrated circuits included in a data driver and a driving method thereof.

2. Discussion of the Related Art

A liquid crystal display controls light transmittance of liquid crystals by using an electric field to display a picture. To this end, the liquid crystal display includes a liquid crystal display panel having a pixel matrix and a driving circuit for driving the liquid crystal display panel. The driving circuit drives the pixel matrix so that picture information can be displayed on the display panel.

FIG. 1 illustrates a related art liquid crystal display device.

Referring to FIG. 1, the related art liquid crystal display device includes a liquid crystal display panel 2, a data driver 4 driving a plurality of data lines DL1 to DLm of the liquid crystal display panel 2, a gate driver 6 driving a plurality of gate lines GL1 to GLn of the liquid crystal display panel.

The liquid crystal display panel 2 further includes a thin film transistor TFT formed at each intersection of the gate lines GL1 to GLn and the data line DL1 to DLm, and liquid crystal cells connected to the thin film transistors and arranged in a matrix.

The gate driver 6 sequentially applies gate signals to the gate lines GL1 to GLn in accordance with control signals from a timing controller (not shown). The data driver 4 converts data R, G and B supplied from the timing controller into video signals as analog signals, and applies the video signals of one horizontal line portion to the data lines DL1 to DLm for each horizontal period when the gate signals are applied to the gate lines GL1 to GLn.

The thin film transistor TFT applies data from the data lines DL1 to DLm to the liquid crystal cells in response to the gate signals from the gate lines GL1 to GLn. The liquid crystal cell is composed of a pixel electrode connected to the TFT and a common electrode facing into each other with the liquid crystal therebetween, thus it can be expressed equivalent to a liquid crystal capacitor Clc. Such a liquid crystal cell includes a storage capacitor (not shown) connected to the previous gate line in order to sustain the data voltage charged in the liquid crystal capacitor Clc until the next data voltage is charged.

In this way, the liquid crystal cells of the related art liquid crystal display panel are located at intersections of the gate lines GL1 to GLn and the data lines DL1 to DLm, respectively. Thus, there are vertical lines formed as many as the data lines DL1 to DLm (i.e., m vertical lines). In other words, the liquid crystal cells are arranged in a matrix to form m vertical lines and n horizontal lines.

As can be seen here, the m data lines DL1 to DLm are required for driving the liquid crystal cells of the m horizontal lines. Accordingly, there is a problem in that the processing time and the fabricating cost are not efficient because a plurality of data lines DL1 to DLm are formed for driving the liquid crystal display panel 2 and a number of data driver integrated circuits IC are required in the data driver 4 for driving the data lines DL1 to DLm in the related art.

SUMMARY OF THE INVENTION

Accordingly, the present invention is directed to a liquid crystal display device and a driving method thereof that substantially obviate one or more of problems due to limitations and disadvantages of the related art.

Another object of the present invention is to provide a liquid crystal display device that is adaptive for reducing the number of integrated circuits in a data driver and a driving method thereof.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a plurality of first data lines connected to a data integrated circuit, a plurality of second data lines connected to liquid crystal cells and having the number of data lines at least one more than that of the first data lines, and a switching part in each of the first data lines applying a video signal supplied from the first data lines to the second data lines.

Herein, the number of first data lines is m/2 (wherein m is a natural number), and the number of second data lines is m.

Herein, the switching part includes a first thin film transistor and a second thin film transistor.

Herein, the first and second thin film transistors have their source terminals commonly connected to the first data lines.

Herein, the first thin film transistor has its drain terminal connected to odd-numbered second data lines, and the second thin film transistor has its drain terminal connected to even-numbered second data lines.

The liquid crystal display device further includes a first control line applying a first driving signal to the first thin film transistor, and a second control line applying a second driving signal to the second thin film transistor, wherein the first and second driving signals are alternately applied.

Herein, the first and second driving signals are alternately changed between a high state and a low state for one horizontal period.

Herein, the first driving signal remains at the high state only for the first half of the one horizontal period, and the second driving signal remains at the high state only for the second half of the one horizontal period.

Herein, the second driving signal remains at the high state only for the first half of the one horizontal period, and the first driving signal remains at the high state only for the second half of the one horizontal period.

Herein, the first thin film transistor applies the video signal supplied from the first data lines to the odd-numbered second data lines when the first driving signal is inputted as the high state.

Herein, the second thin film transistor applies the video signal supplied from the first data lines to the even-numbered second data lines when the second driving signal is inputted as the high state.

Herein, the switching part is formed to overlap a black matrix.

Herein, each of the first and second thin film transistors includes a gate electrode on a substrate, a gate insulating layer on the gate electrode, a semiconductor layer on the gate insulating layer, a spurce electrode and a drain electrode on the semiconductor layer, and a protective layer on the source electrode and the drain electrode.

Herein, the semiconductor layer includes an undoped active layer on the gate insulating layer, and a doped ohmic contact layer on the active layer.

Herein, the undoped active layer and the doped ohmic contact layer are formed of amorphous silicon.

Herein, the semiconductor layer, the source electrode, and the drain electrode are formed with the same mask.

Herein, the semiconductor layer, the source electrode, and the drain electrode are formed with different masks.

In another aspect of the present invention, a liquid crystal display device includes n/2 (wherein n is a natural number) of first data lines, n of second data lines formed at a display area where a picture is displayed, a plurality of switching parts at a non-display area corresponding to each of the first data lines, and a plurality of gate lines crossing the second data lines.

Herein, the switching part applies the video signal supplied from the first data lines to the second data lines, wherein the number of the second data lines is one more than that of the first data lines.

The liquid crystal display device further includes a thin film transistor at each intersection of the second data lines and the gate lines, and a liquid crystal cell connected to the thin film transistor.

The liquid crystal display device further includes a first control line and a second control line at the non-display area connected to each of the switching parts.

Herein, the switching part includes a first thin film transistor and a second thin film transistor.

Herein, the first and second thin film transistors have their source terminal commonly connected to the first data lines.

Herein, the first thin film transistor has its drain terminal connected to odd-numbered second data lines and its gate terminal connected to the first control line.

Herein, the second thin film transistor has its drain terminal connected to even-numbered second data lines and its gate terminal connected to the second control line.

Herein, the first and second thin film transistors are alternately turned on and off to apply the video signal supplied from the first data lines to odd-numbered second data lines and even-numbered second data lines.

The liquid crystal display device further includes a black matrix overlapping the non-display area.

In a further aspect of the present invention, a driving apparatus of a liquid crystal display device includes n/2 (wherein n is a natural number) of first data lines, n of second data lines at a display area where,a picture is displayed, a plurality of switching parts at a non-display area corresponding to each of the first data lines, a first control line and a second control line at the non-display area connected to each of the switching parts, a plurality of gate lines crossing the second data lines, a data driver applying a video signal to the first data lines, a gate driver sequentially applying a gate signal to the gate lines, and a timing controller controlling the data driver and the gate driver.

Herein, the data driver sequentially applies the video signal for two vertical lines to the first data lines for one horizontal period.

Herein, the data driver sequentially applies an odd-numbered video signal and an even-numbered video signal for the one horizontal period.

Herein, the data driver sequentially applies an even-numbered video signal and an odd-numbered video signal for the one horizontal period.

Herein, the timing controller applies a first driving signal and a second driving signal to the first and second control lines, wherein the first and second driving signals are alternately and repeatedly changed between a high signal and a low signal.

Herein, the first and second driving signals are alternately changed between the high signal and the low signal for one horizontal period.

Herein, the switching parts apply an odd-numbered video signal supplied to the first data lines when the first driving signal is in a high state to odd-numbered second data lines, and apply an even-numbered video signal supplied to the first data lines when the second driving signal is in the high state to even-numbered second data lines.

Herein, the timing controller uses a source sampling clock utilized as a sampling clock for latching data in the data driver as the first driving signal, and uses an inverted signal of the source sampling clock as the second driving signal.

Herein, the timing controller uses a source sampling clock utilized as a sampling clock for latching data in the data driver as the second driving signal, and uses an inverted signal of the source sampling clock as the first driving signal.

The driving apparatus further includes a control signal generator connected to the timing controller applying a first driving signal and a second driving signal that are alternately and repeatedly changed between a high signal and a low signal by using a control signal supplied from the timing controller to the first and second control lines.

Herein, the first and second driving signals are alternately changed between a high state and a low state for one horizontal period.

Herein, the switching parts apply an odd-numbered video signal supplied to the first data lines when the first driving signal is in the high state to odd-numbered second data lines, and apply an even-numbered video signal supplied to the first data lines when the second driving signal is in the high state to even-numbered second data lines.

Herein, the control signal generator uses a source sampling clock utilized as a sampling clock for latching data in the data driver as the first driving signal, and uses an inverted signal of the source sampling clock as the second driving signal.

Herein, the timing controller uses a source sampling clock utilized as a sampling clock,for latching data in the data driver as the second driving signal, and uses an inverted signal of the source sampling clock SSC as the first driving signal.

It is to be understood that,both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 2:
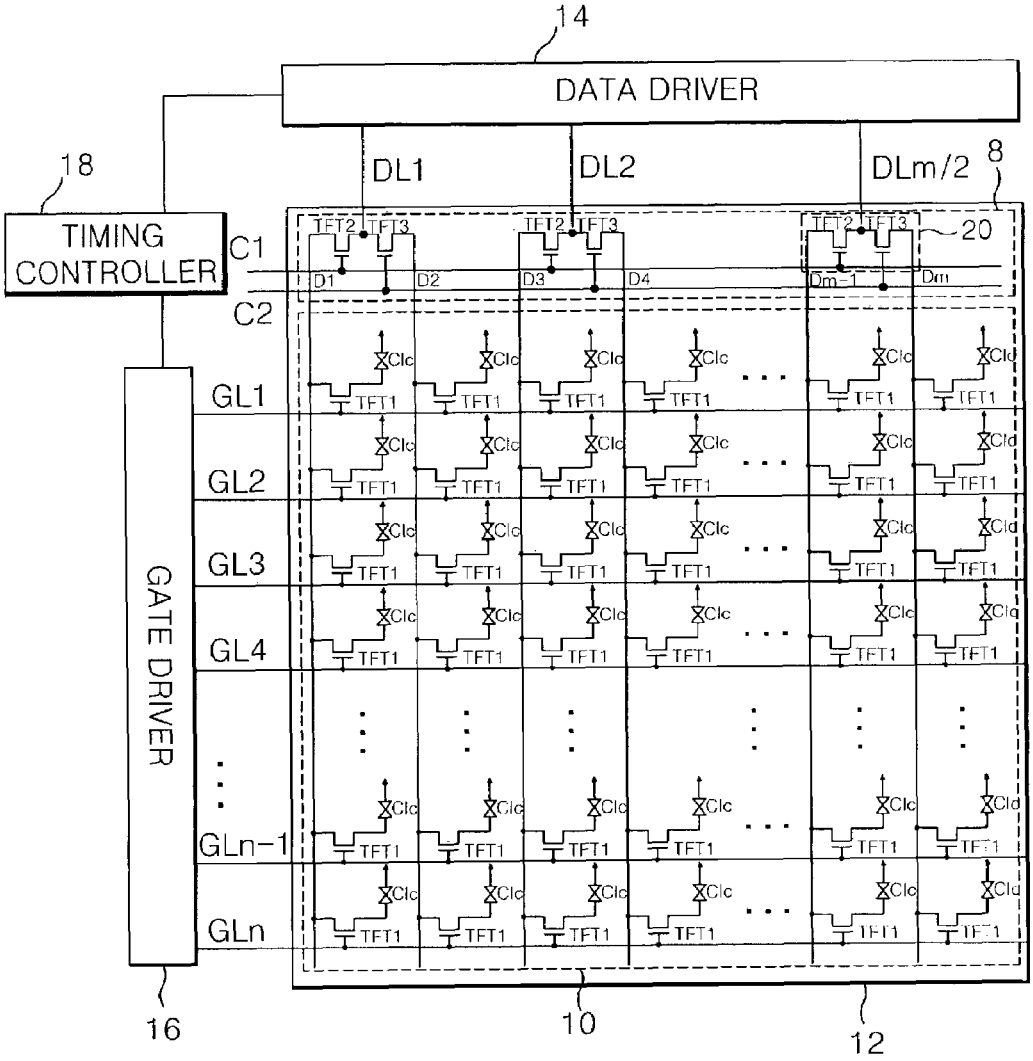
FIG. 2 illustrates a schematic diagram for a liquid crystal display device according to a first embodiment of the present invention.

FIG. 2 illustrates a schematic diagram for a liquid crystal display device according to a first embodiment of the present invention.

Referring to FIG. 2, the liquid crystal display device according to the first embodiment of the present invention includes a liquid crystal display panel 12, a data driver 14 driving first data lines DL1 to DLm/2 of the liquid crystal display panel 12, a gate driver 16 driving gate lines GL1 to GLn of the liquid crystal display panel 12, and a timing controller 18 controlling the data driver 14 and the gate driver 16.

The gate driver 16 sequentially applies gate signals to the gate lines GL1 to GLn in accordance with gate control signals from the timing controller 18.

The data driver 14 converts data R, G, and B into video signals as analog signals in accordance with data control signals supplied from the timing controller 18 and applies the video signals to the first data lines DL1 to DLm/2 for each horizontal period when the gate signals are applied to the gate lines GL1 to GLn. The video signals supplied to the first data lines are applied to second data lines by controlling a switching part 8. In this way, the data driver 14 sequentially applies the video signals corresponding to two vertical lines to one of the first data lines DL for one horizontal period.

Figure 3:
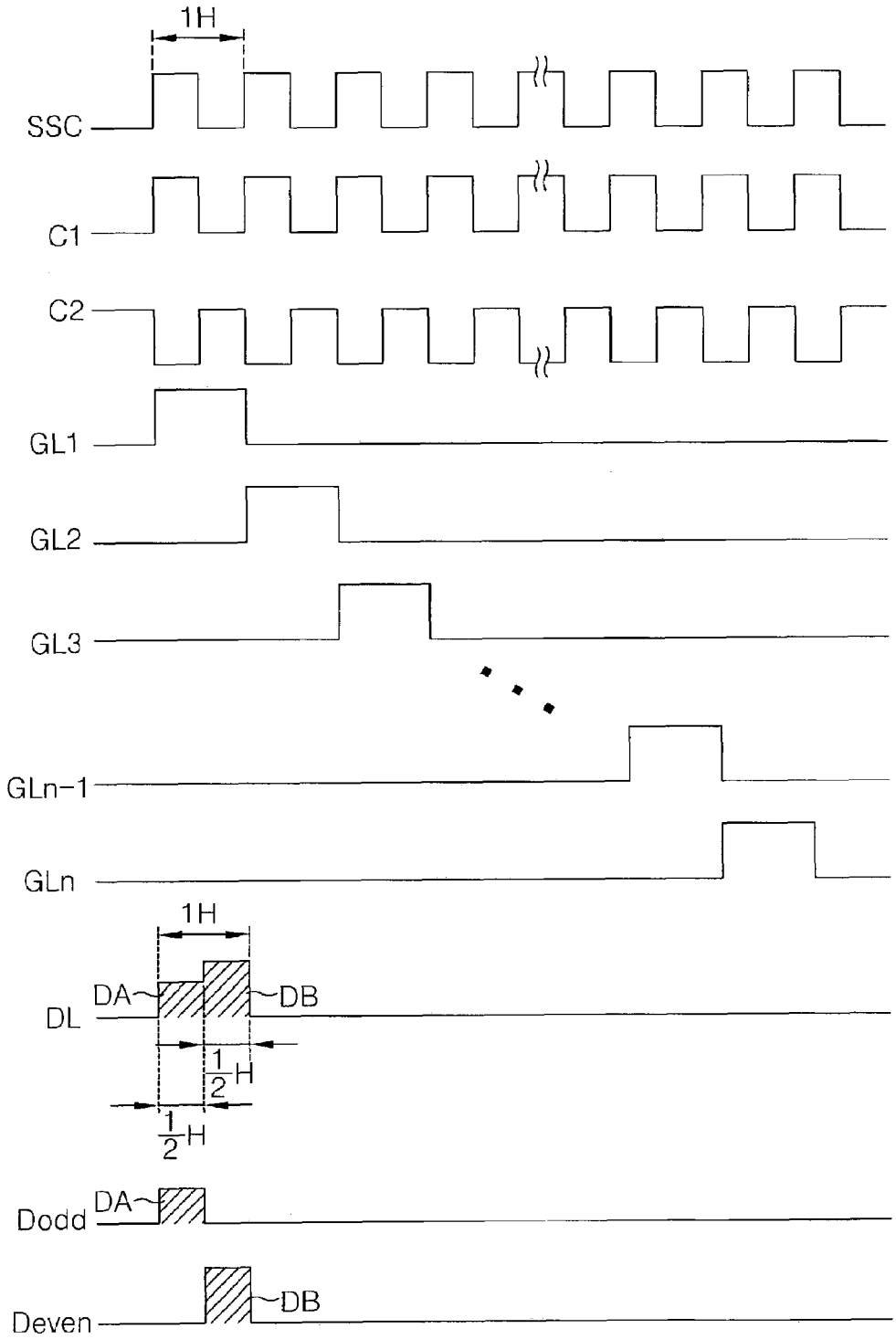
FIGS. 3 and 4 are waveform diagrams illustrating driving waveforms applied to the liquid crystal display device of FIG. 2.

To more fully describe the first embodiment with reference to FIG. 3, the data driver 14 applies first video signals DA corresponding to the odd-numbered vertical lines to the first data lines DL during a half period ½ H, either the first half or the second half, of one horizontal period 1 H. The odd-numbered vertical lines are the odd-numbered second data lines D1, D3, D5 and . . . . Then, the data driver 14 applies second video signals DB corresponding to the even-numbered vertical lines to the first data line DL during another half period ½ H, either the second half or the first half, of one horizontal period 1 H. The even-numbered vertical lines are the even-numbered second data lines D2, D4, D6 and . . . .

Figure 1:
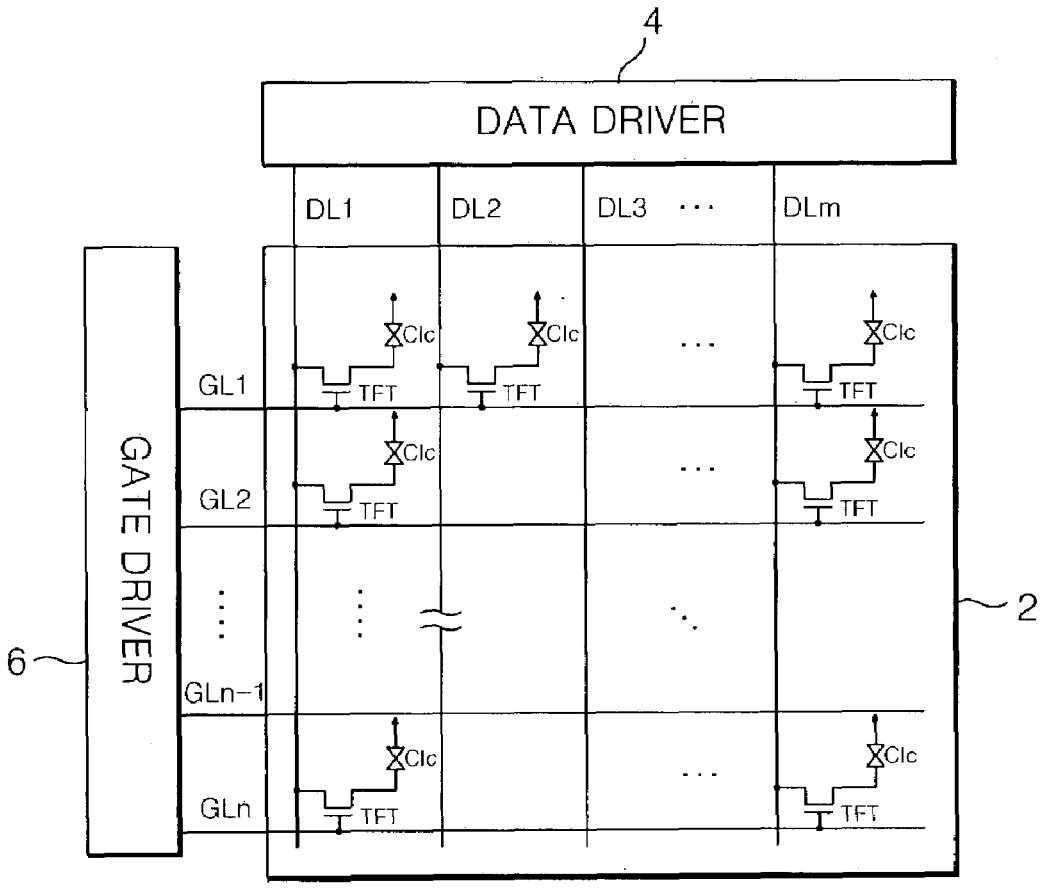
FIG. 1 RELATED ART
FIG. 1 illustrates a schematic diagram for a related art liquid crystal display device.

In other words, the data driver 14 of the present invention sequentially applies the odd-numbered (or even-numbered) and even-numbered (or odd-numbered) video signals to each of the first data lines DL for one horizontal period. In this way, when one of the first data lines DL is supplied with the odd-numbered and even-numbered video signals in the data driver 14, the number of the first data lines DL1 to DLm/2 to which the video signals are applied can be reduced to a half of that of data lines DL1 to DLm of the related art liquid crystal display device shown in FIG. 1. Therefore, the data driver 14 according to the first embodiment of the present invention requires driver IC's corresponding to a half of the number of the related art data driver IC's, thereby reducing its fabricating cost.

The timing controller 18 receives synchronization signals, control signals, and data from the outside. The timing controller 18 receiving the synchronization signals and the control signals generates gate control signals for controlling the gate driver and applies the gate control signals to the gate driver 16. The timing controller 18 receiving the synchronization signals and the control signals applies the data supplied from the outside and data control signals for controlling the data driver to the data driver 14.

Further, the timing controller 18 applies a first driving signal and a second driving signal to control lines C1 and C2 of the liquid crystal panel 12 by using the control signal supplied from,the outside. In, other words, the timing controller 18 generates the first and second driving signals, which are to be applied to the control lines C1 and C2, by using a source sampling clock SSC. More specifically, the source sampling clock SSC is a sampling clock for latching the data in the data driver 14 and has a period of one horizontal interval, as shown in FIG. 3. The timing controller 18 applies the source sampling clock SSC to the first control line C1, which is then used as a first driving signal. Also, the timing controller 18 applies the signal having the inverted source sampling clock SSC, which is then used as a second driving signal, to the second control line C2.

The liquid crystal display panel 12 is divided into a display area 10 and a non-display area 8. The display area 10 is an area where a specific picture corresponding to the video signal is displayed. On the other hand, the non-display area 8 is an area where a picture is not displayed and is located to overlap a black matrix (not shown).

The display area 10 includes a first thin film transistor TFT1 formed at each intersection of the second data lines D and the gate lines GL, and liquid crystal cells arranged in a matrix form and connected to the first thin film transistor TFT1.

The first thin film transistor TFT1 responds to the gate signal from the gate line GL1 to GLn in order to apply the data supplied from the second data line D1 to Dm to the liquid crystal cell. The liquid crystal cell is composed of a pixel electrode connected to the first thin film transistor TFT1, and a pair of common electrodes facing into each other and having liquid crystal therebetween. Therefore, the liquid crystal cell can be expressed to be equivalent to a liquid crystal capacitor Clc. The liquid crystal cell includes a storage capacitor (not shown) connected to the previous gate line in order to sustain the data voltage charged in the liquid crystal capacitor Clc until the next data voltage is charged.

The non-display area 8 includes a plurality of switching parts 20, and the control lines C1 and C2 for driving the switching parts 20. Each of the switching parts 20 is connected to one of the first data lines DL1 to DLm/2. The switching part 20 separates the video signals supplied from one of the first data lines DL into two second data lines D, and applies the divided second data lines D. In other words, the switching part 20 is formed in each of m/2 first data lines DL and separates the video signals supplied from the m/2 first data lines DL into m second data-lines D, and applies the second data lines.

Each of the switching parts 20 includes a second thin film transistor TFT2 and a third thin film transistor TFT3. The second thin film transistor TFT2 has its gate terminal connected to the first control line C1, and its source terminal connected to the first data line DL. And, the drain terminal of the second thin film transistor TFT2 is connected to the odd-numbered second data lines D. Further, the third thin film transistor TFT3 has its gate terminal connected to the second control line C2, and its source terminal connected to the first data line DL. And, the drain terminal of the third thin film transistor TFT3,is connected to the even-numbered second data lines D.

To describe an operation process of the liquid crystal display device according, to the first embodiment of the present invention with reference to FIG. 3, the timing controller 18 has a period of one horizontal interval and applies the first and second driving signals having opposite polarities to the first and second control lines C1 and C2. And, the data driver 14 applies the odd-numbered video signals to the first data lines DL1 to DLm/2 for the first half period of one horizontal period, and applies the even-numbered video signals to the first data lines DL1 to DLm/2 for the second half period of one horizontal period. Further, the gate driver 16 sequentially applies the gate signals corresponding to the one horizontal period.

The first driving signal of high state is applied to the first control line C1 during the first half period of one horizontal period to turn on the second thin film transistor TFT2. At this point, the second driving signal of low state is applied to the second control line C2 to turn off the third thin film transistor TFT3. And, the gate signal is supplied to one of gate lines, herein, the $i^{th}$ (wherein i is a natural number) gate line GLi, of the gate lines GL1 to GLn during the first horizontal period. When the gate signal is applied to the $i^{th}$ gate line GLi, the gate signal turns on the first thin film transistor TFT1 connected to the $i^{th}$ gate line GLi.

Then, during the first half period of one horizontal period, the odd-numbered video signals DA-are applied to the first data lines DL, and then,to the odd-numbered second data lines D1, D3, D5 and . . . , through, the second thin film transistor TFT2. The odd-numbered video signals DA supplied to the odd-numbered second data lines D1, D3, D5 and . . . , are applied to the liquid crystal cell through the first thin film transistor TFT1 connected to the odd-numbered second data line D1, D3, D5 and . . . . In other words, during the first half period of one horizontal period, the video signals DA supplied to the odd-numbered second data lines D1, D3, D5 and . . . , are applied to the liquid crystal cells located in the odd-numbered vertical lines.

Further, during the second half period of one horizontal period, the second driving signal of high state is applied to the second control line C2 to turn on the third thin film transistor TFT3. At this point, the first driving signal of low state is applied to the first control line C1 to turn off the second thin film transistor TFT2.

Then, during the second half period of one horizontal period, the even-numbered video signals DB are applied to the first data lines DL, and then to the even-numbered second data lines D2, D4, D6 and . . . , through the third thin film transistor TFT3. The even-numbered video signals DB supplied to the even-numbered second data lines D2, D4, D6 and . . . , are applied to the liquid crystal cell through the first thin film transistor TFT1 connected to the even-numbered second data line D2, D4, D6 and . . . . In other words, during the second half period of one horizontal period, the video signals DB supplied to the even-numbered second data lines D2, D4, D6 and . . . , are applied to the liquid crystal cells located in the even-numbered vertical lines.

Figure 4:
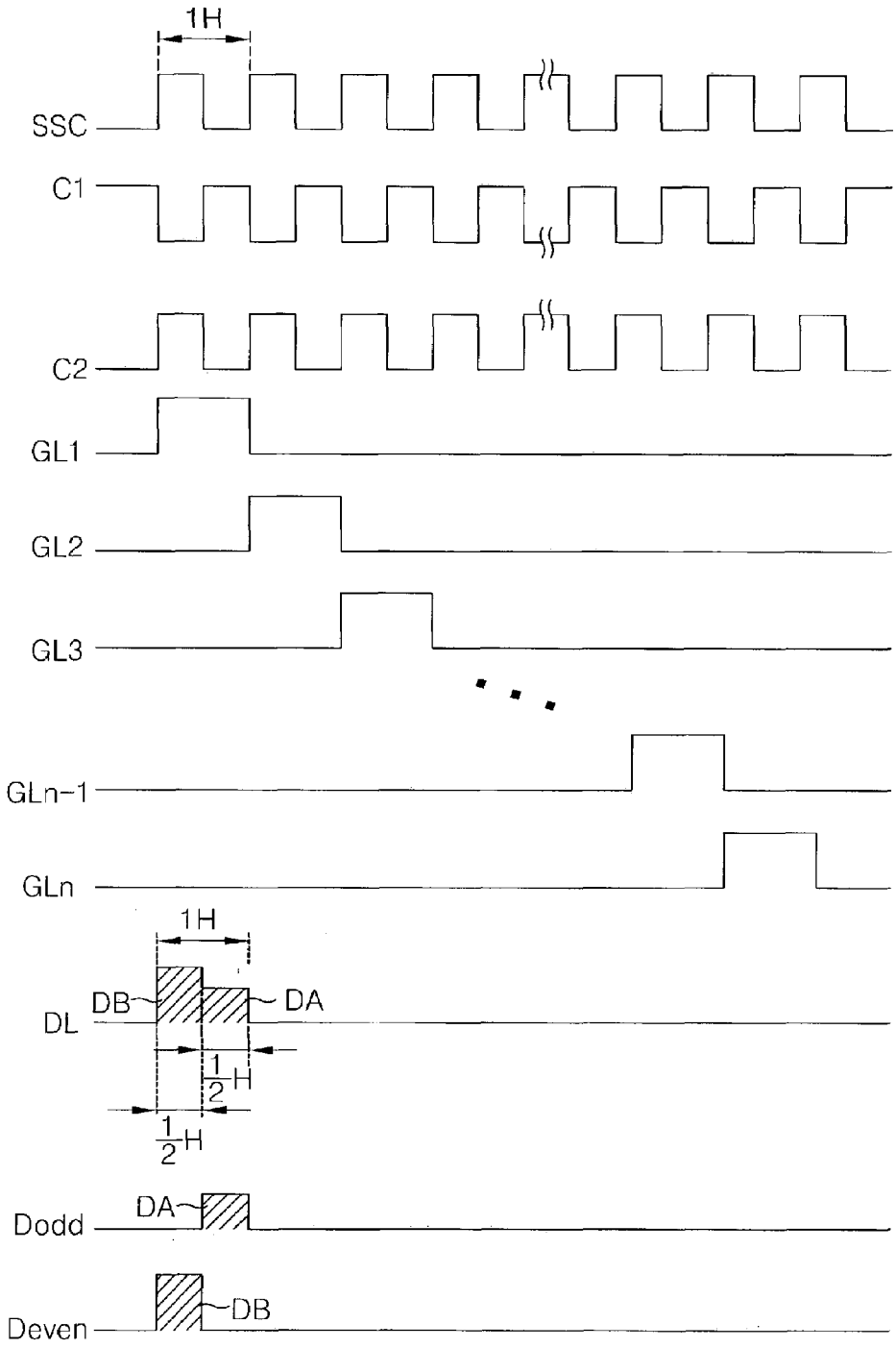

On the other hand, the liquid crystal cell according to the first embodiment of the present invention can be driven, as shown in FIG. 4. To describe an operation process with reference to FIG. 4, the timing controller 18 has a period of one horizontal interval and applies the first and second driving signals having opposite polarities to the first and second control lines C1, and C2. And, the data driver 14 applies the even-numbered video signals DB to the first data lines DL1 to DLm/2 for the first half period of one horizontal period, and applies the odd-numbered video signals to the first data lines DL1 to DLm/2 for the second half period of one horizontal period. Further, the gate driver 16 sequentially applies the gate signals corresponding to the one horizontal period.

During the first half of one horizontal period, the second driving signal of high state is applied to the second control line C2 to turn on the third thin film transistor TFT3. At this point, the first driving signal of low state is applied to the first control line C1 to turn off the second thin film transistor TFT2. And, a gate signal is applied to the $i^{th}$ gate line for one horizontal period to turn on the first thin film transistor TFT1 connected to the $i^{th}$ gate line GLi.

Then, during the first half of one horizontal period, the even-numbered video signals DB are applied to the first data lines DL, and then to the even-numbered second data lines D2, D4, D6 and . . . , through the third thin film transistor TFT3. The even-numbered video signals DB supplied to the even-numbered second data lines D2, D4, D6 and . . . , are applied to the liquid crystal cell through the first thin film transistor TFT1 connected to the even-numbered second data line D2, D4, D6 and . . . . In other words, during the first half of one horizontal period, the video signals DB supplied to the even-numbered second data lines D2, D4, D6 and . . . , are applied to the liquid crystal cells located in the even-numbered vertical lines.

Further, during the second half of one horizontal period, the first driving signal of high state is applied to the first control line C1 to turn on the second thin film transistor TFT2. At this moment, the second driving signal of low state is applied to the second control line C2 to turn off the third thin film transistor TFT3.

Then, during the second half of one horizontal period, the odd-numbered video signals DA are applied to the first data lines DL, and then to the odd-numbered second data lines D1, D3, D5 and . . . , through the second thin film transistor TFT2. The odd-numbered video signals DA supplied to the odd-numbered second data lines D1, D3, D5 and, . . . , are applied to the liquid crystal cell through the 1 first thin film transistor TFT1 connected to the odd-numbered second data line D1, D3, D5 and . . . . In other words, during the second half of one horizontal period, the video signals DA supplied to the odd-numbered second data lines D1, D3, D5 and . . . , are applied to the liquid crystal cells located in the odd-numbered vertical lines.

Figure 5:
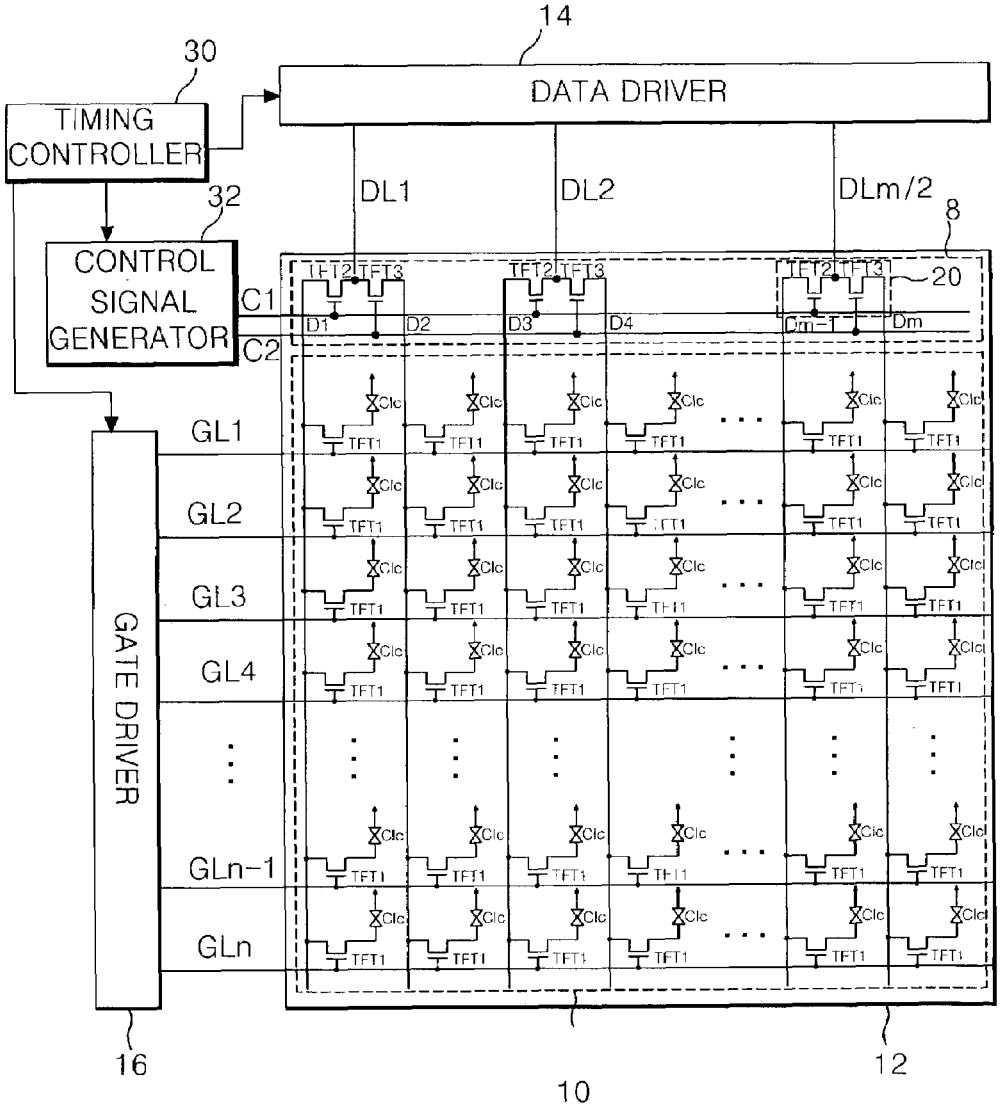
FIG. 5 illustrates a schematic diagram for a liquid crystal display device according to a second embodiment of the present invention.

FIG. 5 illustrates a schematic diagram for a liquid crystal display device according to a second embodiment of the present invention. Elements of FIG. 5 having the same function as those of FIG. 2 are given the same reference numerals, so a detailed description thereof will be omitted for simplicity.

Referring to FIG. 5, the liquid crystal display device according to the second embodiment of the present invention includes a liquid crystal display panel 12, a data driver 14 driving first data lines DL1 to DLm/2 of the liquid crystal display panel 12, a gate driver,16 driving gate lines GL1 to GLn of the liquid crystal display panel 12, a timing controller 30 controlling the data driver 14 and the gate driver 16, and a control signal generator 32 generating a first driving signal and a second driving signal by controlling the timing controller 30.

The gate driver 16 sequentially applies gate signals to the gate lines GL1 to GLn in accordance with gate control signals from the timing controller 30.

The data driver 14 converts data R, G, and B into video signals as analog signals in accordance with data control signals supplied from the timing controller 30 and applies the video signals to the first data lines DL1 to DLm/2 for each horizontal period when the gate signals are applied to the gate lines GL1 to GLn. In this way, the data driver 14 sequentially applies the video signals corresponding to two vertical lines for one horizontal period to one of the first data lines DL.

The timing controller 30 receives synchronization signals, control signals, and data from the outside. The timing controller 30 receiving the synchronization signals and the control signals generates gate control signals for controlling the gate driver and applies the gate control signals to the gate driver 16. Also, the timing controller 30 receiving the synchronization signals and the control signals applies the data supplied from the outside and data control signals for controlling the data driver to the data driver 14. And, the timing controller 30 controls the control signal generator 32 so that the first and second driving signals generated from the control signal generator 32 can be applied at a desired time.

The control signal generator 32 uses a source sampling clock SSC supplied from the timing controller 30 to generate the first and second driving signals that are to be applied to control lines C1 and C2. More specifically, the source sampling clock SSC is a sampling clock that latches the data in the data driver 14, and has a,period of one horizontal interval, as shown in FIG. 3. The control signal generator 32 applies the source sampling clock SSC to the first control line C1, which is then used as the first driving signal. And, the control signal generator 32 applies the source sampling clock to the second control line C2, which is then used as the second driving signal.

On the other hand, the control signal generator 32 applies the signal having the inverted source sampling clock, as shown in FIG. 4, to the first control line C1, thereby allowing the control signal generator 32 to use the signal as the first driving signal. At this point, the source sampling clock SSC is applied to the second control line C2 to be used as the second driving signal.

The second embodiment of the present invention includes the control signal generator 32 for generating the first and second driving signals. More specifically, in the first embodiment of the present invention, the first and second driving signals are generated by the timing controller 18. Conversely, in the second embodiment of the present invention, the first and second driving signals are generated by the control signal generator 32. Meanwhile, an operation characteristic of the second embodiment of the present invention is similar to that of the first embodiment of the present invention, thus a detailed description is omitted for simplicity.

Figure 6:
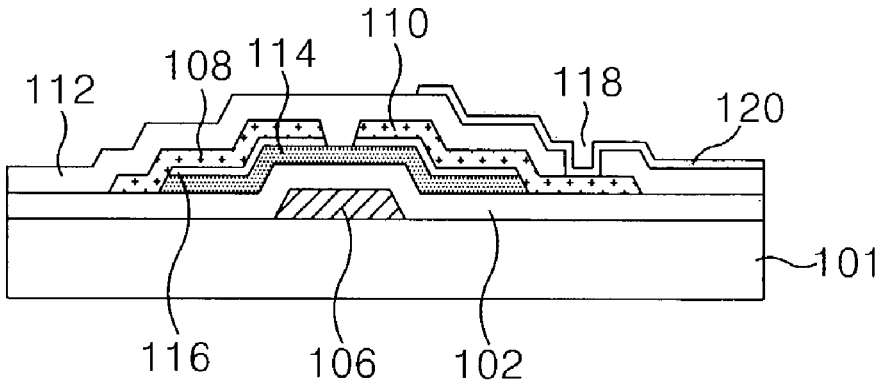
FIG. 6 is a cross-sectional view illustrating a structure of the thin film transistor according to the present invention.

On the other hand, a cross-sectional view of the thin film transistor TFT of the present invention is illustrated in FIG. 6.

Referring to FIG. 6, the thin film transistor TFT includes a gate electrode 106 formed on a lower substrate 101, a source electrode 108 and a drain electrode 110 formed in a layer different from that of the gate electrode 106. Herein, the drain electrode 110 is formed to be contacted with a pixel electrode 120 through a drain contact hole 118. The drain electrode 110 is contacted to the pixel electrode 120 or the adjacent thin film transistor TFT.

An active layer 114 and an ohmic contact layer 116 are deposited to form a conduction channel between the gate electrode 106, and the source electrode 108 and the drain electrode 110. Herein, the active layer 114 and the ohmic contact layer 116, are collectively called semiconductor layers. The ohmic contact layer 116 is formed between the active layer 114 and the source electrode 108 and between the active layer 114 and the drain electrode 110. The active layer 114 is formed of the amorphous silicon without doping. The ohmic contact layer 116 is formed of the amorphous silicon doped with an n-type or a p-type dopant. When a voltage is applied to the gate electrode 106, the semiconductor layers 114 and 116 apply the voltage supplied to the source electrode 108 to the drain electrode 110. A gate insulating layer 112 formed between the gate electrode 106 and the semiconductor layers 114 and 116. A protective layer 112 formed on the source electrode 108 and the drain electrode 110.

The source electrode 108 and the drain electrode 110 of the thin film transistor TFT included in the embodiments of the present invention may be formed with a mask different from those used in the semiconductor layers 114 and 116. Accordingly, the source electrode 108 and the drain electrode 110 have a pattern different from those of used in the semiconductor layers 114 and 116.

Figure 7:
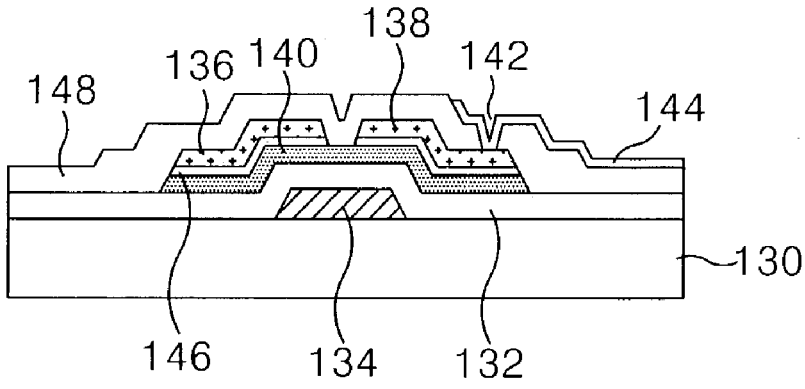
FIG. 7 is a cross-sectional view illustrating another structure of the thin film transistor according to the present invention.

FIG. 7 is a cross-sectional view illustrating another structure of the thin film transistor of the present invention.

Referring to FIG. 7, the thin film transistor TFT according to the present invention includes a gate electrode 134 formed on a lower substrate 130, a source electrode 136 and a drain electrode 138 formed in a layer different from that of the gate electrode 134. Herein, the drain electrode 138 is formed to be contacted with a pixel electrode 144 through a drain contact hole 142. The drain electrode 138 is contacted to the pixel electrode 144 or the adjacent thin film transistor TFT.

An active layer 140 and an ohmic contact layer 146 (collectively called semiconductor layers) are deposited to form a conduction channel between the gate electrode 134, and the source electrode 136 and the drain electrode 138. The ohmic contact layer 146 is formed between the active layer 140 and the source electrode 136 and between the active layer 140 and the drain electrode 138. The active layer 104 is formed of the amorphous silicon without doping. The ohmic contact layer 146 is formed of the amorphous silicon doped with an n-type or a p-type dopant. The semiconductor layers 140 and 146 apply the voltage supplied to the source electrode 136 to the drain electrode 138 when a voltage is applied to the gate electrode 134. A gate insulating layer 132 formed between the gate electrode 134 and the semiconductor layers 140 and 146. A protective layer 148, formed on the source electrode 136 and the drain electrode 138. The source electrode 136 and the drain electrode 138 of the thin film transistor TFT included in the embodiments of the present invention are formed with the same mask as those, used in the semiconductor layers 140 and 146.

As described above, according to the liquid crystal display device and the driving method thereof in the present invention, the odd-numbered and even-numbered video signals are sequentially applied to one of the data lines during one horizontal period, thereby reducing the number of data driver IC's and reducing its fabricating cost accordingly. In addition, since only one thin film transistor is required for driving the liquid crystal cell in the present invention, the number of data driver IC's can be reduced without changing an aperture ratio.

It will be apparent to those skilled in the art that various modifications and variations can be made in the liquid crystal display device and the driving method thereof of the present invention without departing from the spirit or scope of the inventions. Thus, it is intended-that the present invention covers the modifications and variations of this invention provided they come within the scope of the appended claims and their equivalents.

What is claimed is:

1. A liquid crystal display device, comprising:

a plurality of first data lines connected to a data integrated circuit;

a plurality of second data lines connected to liquid crystal cells and wherein the number of second data lines is at least one more than that of the first data lines; and a switching part connected to each of the first data lines and two of the second data lines, wherein the switching part sequentially applies a first video signal from the first data lines to odd-numbered second data lines during a first half-period of one horizontal period and a second video signal from the first data lines to even-numbered second data lines during a second half-period of the one horizontal period.

2. The liquid crystal display device according to claim 1, wherein the number of first data lines is m/2 (wherein m is a natural number and m≧2), and the number of second data lines is m.

3. The liquid crystal display device according to claim 1, wherein the switching part includes a first thin film transistor and a second thin film transistor.

4. The liquid crystal display device according to claim 3, wherein the first and second thin film transistors have their source terminals commonly connected to the first data lines.

5. The liquid crystal display device according to claim 4, wherein the first thin film transistor has its drain terminal connected to odd-numbered second data lines, and the second thin film transistor has its drain terminal connected to even-numbered second data lines.

6. The liquid crystal display device according to claim 5, further comprising:

a first control line applying a first driving signal to the first thin film transistor; and a second control line applying a second driving signal to the second thin film transistor, wherein the first and second driving signals are alternately applied.

7. The liquid crystal display device according to claim 6, wherein the first and second driving signals are alternately changed between a high state and a low state for the one horizontal period.

8. The liquid crystal display device according to claim 7, wherein the first driving signal remains at the high state only for the first half of the one horizontal period, and the second driving signal remains at the high state only for the second half of the one horizontal period.

9. The liquid crystal display device according to claim 7, wherein the second driving signal remains at the high state only for the first half of the one horizontal period, and the first driving signal remains at the high state only for the second half of the one horizontal period.

10. The liquid crystal display device according to claim 7, wherein the first thin film transistor applies the first video signal supplied from the first data lines to the odd-numbered second data lines when the first driving signal in inputted as the high state.

11. The liquid crystal display device according to claim 7, wherein the second thin film transistor applies the second video signal supplied from the first data lines to the even-numbered second data lines when the second driving signal is inputted as the high state.

12. The liquid crystal display device according to claim 3, wherein each of the first and second thin film transistors includes:

a gate electrode on a substrate;

a gate insulating layer on the gate electrode;

a semiconductor layer on the gate insulating layer;

a source electrode and a drain electrode on the semiconductor layer; and a protective layer on the source electrode and the drain electrode.

13. The liquid crystal display device according to claim 12, wherein the semiconductor layer includes:

an undoped active layer on the gate insulating layer; and a doped ohmic contact layer on the active layer.

14. The liquid crystal display device according to claim 13, wherein the undoped active layer and the doped ohmic silicon layer are formed of amorphous silicon.

15. The liquid crystal display device according to claim 12, wherein the semiconductor layer, the source electrode, and the drain electrode are formed with the same mask.

16. The liquid crystal display device according to claim 12, wherein the semiconductor layer, the source electrode, and the drain electrode are formed with different masks.

17. The liquid crystal display device according to claim 1, wherein the switching part is formed to overlap a black matrix.

18. A liquid crystal display device, comprising:

m/2 (wherein m is a natural number, and m≧2) first data lines;

n (wherein n is a natural number, and n≧2) second data lines formed at a display area where a picture is displayed;

a plurality of switching parts at a non-display area corresponding to each of the first data lines and corresponding to two of the second data lines; and a plurality of gate lines crossing the second data lines, wherein the plurality of switching parts sequentially applies a first video signal from the first data lines to odd-numbered second data lines during a first half-period of one horizontal period and a second video signal from the first data lines to even-numbered second data lines during a second half-period of the one horizontal period.

19. The liquid crystal display device according to claim 18, wherein the number of the second data lines is one more than that of the first data lines.

20. The liquid crystal display device according to claim 18, further comprising:

a thin film transistor at each intersection of the second data lines and the gate lines; and a liquid crystal cell connected to the thin film transistor.

21. The liquid crystal display device according to claim 18, further including a first control line and a second control line at the non-display area connected to each of the switching parts.

22. The liquid crystal display device according to claim 21, wherein the switching part includes a first thin film transistor and a second thin film transistor.

23. The liquid crystal display device according to claim 22, wherein the first and second thin film transistors have their source terminals commonly connected to the first data lines.

24. The liquid crystal display device according to claim 23, wherein the first thin film transistor has its drain terminal connected to odd-numbered second data lines and its gate terminal connected to the first control line.

25. The liquid crystal display device according to claim 23, wherein the second thin film transistor has its drain terminal connected to even-numbered second data line and its gate terminal connected to the second control line.

26. The liquid crystal display device according to claim 23, wherein the first and second thin film transistors are alternately turned on and off to apply the first video signal supplied from the first data lines to odd-numbered second data lines and the second video signal from the first data lines to the even-numbered second data lines for the one horizontal period.

27. The liquid crystal display device according to claim 18, further including a black matrix overlapping the non-display area.

28. A driving apparatus of a liquid crystal display device, comprising:

m/2 (wherein m is a natural number, and m≧2) first data lines;

n (wherein n is a natural number, and n≧2) second data lines at a display area where a picture is displayed;

a plurality of switching parts at a non-display area corresponding to each of the first data lines and corresponding to two of the second data lines;

a first control line and a second control line at the non-display area connected to each of the switching parts;

a plurality of gate lines crossing the second data lines;

a data driver;

a gate driver sequentially applying a gate signal to the gate lines; and a timing controller controlling the data driver and the gate driver, wherein:

the timing controller has one horizontal period, the data driver sequentially applies a first video signal to the first data lines and odd-numbered second data lines during a first half-period of the one horizontal period, and a second video signal to the first data lines and even-numbered second data lines during a second half-period of the one horizontal period.

29. The driving apparatus according to claim 28, wherein the timing controller applies a first driving signal and a second driving signal to the first and second control lines, wherein the first and second driving signals are alternately and repeatedly changed between a high signal and a low signal.

30. The driving apparatus according to claim 29, wherein the first and second driving signals are alternately changed between the high signal and the low signal for the one horizontal period.

31. The driving apparatus according to claim 29, wherein the switching parts apply the first video signal from the first data lines to the odd-numbered second data lines when the first driving signal is in a high state, and apply the second video signal from the first data lines to the even-numbered second data lines when the second driving signal is in the high state.

32. The driving apparatus according to claim 29, wherein the timing controller uses a source sampling clock utilized as a sampling clock for latching data in the data driver as the first driving signal, and uses an inverted signal of the source sampling clock as the second driving signal.

33. The driving apparatus according to claim 29, wherein the timing controller uses a source sampling clock utilized as a sampling clock for latching data in the data driver as the second driving signal, and uses an inverted signal of the source sampling clock as the first driving signal.

34. The driving apparatus according to claim 28, further including a control signal generator connected to the timing controller applying a first driving signal and a second driving signal that are alternately and repeatedly changed between a high signal and a low signal by using a control signal supplied from the timing controller to the first and second control lines.

35. The driving apparatus according to claim 34, wherein the first and second driving signals are alternately changed between a high state and a low state for the one horizontal period.

36. The driving apparatus according to claim 35, wherein the switching parts apply the first video signal from the first data lines to the odd-numbered second data lines when the first driving signal is in a high state, and apply the second video signal from the first data lines to the even-numbered second data lines when the second driving signal is in the high state.

37. The driving apparatus according to claim 34, wherein the control signal generator uses a source sampling clock utilized as a sampling clock for latching data in the data driver as the first driving signal, and uses an inverted signal of the source sampling clock as the second driving signal.

38. The driving apparatus according to claim 34, wherein the timing controller uses a source sampling clock utilized as a sampling clock for latching data in the data driver as the second driving signal, and uses an inverted signal of the source sampling clock as the first driving signal.

39. A driving apparatus of a liquid crystal display device, comprising:

m/2 (wherein m is a natural number, and m≧2) first data lines;

n (wherein n is a natural number, and n≧2) second data lines at a display area where a picture is displayed;

a plurality of switching parts at a non-display area corresponding to each of the first data lines and corresponding to two of the second data lines;

a first control line and a second control line at the non-display area connected to each of the switching parts;

a plurality of gate lines crossing the second data lines;

a data driver;

a gate driver sequentially applying a gate signal to the gate lines; and a timing controller controlling the data driver and the gate driver, wherein:

the timing controller has one horizontal period, the data driver sequentially applies a first video signal to the first data lines and even-numbered second data lines during a first half-period of the one horizontal period, and a second video signal to the first data lines and odd-numbered second data lines during a second half-period of the one horizontal period.

* * * * *